US005158197A

United States Patent [19]

Richter et al.

[11] Patent Number: 5,158,197

[45] Date of Patent: Oct. 27, 1992

[54] TAMPER EVIDENT DEVICE FOR SOFT DRINK SYRUP CONTAINERS

[75] Inventors: Simon J. Richter, Marietta, Ga.; Rodney D. Borst, Oregon; Patrick J. Propsom, Madison, both of Wis.

[73] Assignee: The Coca-Cola Company, Atlanta, Ga.

[21] Appl. No.: 739,753

[22] Filed: Aug. 2, 1991

[51] Int. Cl.[5] ..... B65D 23/08

[52] U.S. Cl. ..... 220/214; 220/257; 220/256; 220/270; 220/266; 220/724; 220/729; 220/915; 220/86.1; 222/182; 222/153; 215/251

[58] Field of Search ..... 220/214, 257, 256, 270, 220/266, 265, 724, 725, 728, 730, 86.1, 915, 729; 215/251; 222/182, 153

[56] References Cited

U.S. PATENT DOCUMENTS

| | | | |
|---|---|---|---|
| 3,129,730 | 4/1964 | Simon | 220/86.1 X |
| 3,561,631 | 2/1971 | Hatfield et al. . | |
| 3,592,351 | 7/1971 | Johnson, Jr. et al. . | |
| 4,095,713 | 6/1978 | Norton | 220/257 X |
| 4,149,651 | 4/1979 | Ignell . | |
| 4,197,960 | 4/1980 | Walter . | |
| 4,276,988 | 1/1980 | Kimm et al. . | |
| 4,318,495 | 3/1982 | Wood | 220/724 X |
| 4,427,134 | 7/1984 | Almouli . | |
| 4,457,445 | 3/1984 | Hanks et al. . | |
| 4,607,759 | 8/1986 | Boetzkes . . | |
| 4,616,763 | 10/1986 | Ruhl | 220/724 X |
| 4,712,705 | 12/1987 | Fuehrer | 220/724 X |
| 4,729,488 | 8/1988 | Bullock, III . | |
| 4,733,787 | 6/1988 | Knopf et al. . | |
| 4,785,963 | 11/1988 | Magley . | |
| 4,874,101 | 10/1989 | Zalut | 215/251 |
| 4,895,270 | 2/1989 | Main et al. . | |

*Primary Examiner*—Stephen Marcus
*Assistant Examiner*—Paul A. Schwarz
*Attorney, Agent, or Firm*—Thomas R. Boston; W. Dexter Brooks

[57] ABSTRACT

A tamper evident device for use on a soft drink syrup container (a figal) comprising a one-piece body including a pair of spaced-apart arms with a socket on the distal end of each arm, the socket including internal locking teeth to lock onto a plug of the syrup container. The sockets include fracture zones and must be broken to be removed. A handle portion joins the two arms and includes a large flat upper surface for use in applying a label thereon identifying the syrup in the container.

21 Claims, 2 Drawing Sheets

TAMPER EVIDENT DEVICE FOR SOFT DRINK SYRUP CONTAINERS

BACKGROUND OF THE INVENTION

This invention relates to soft drink syrup containers and in particular to a tamper evident device for such containers.

Cylindrical, stainless steel soft drink containers for holding five gallons of syrup are well-known in this art (and are known as "figals"). Such containers include a top wall with a central fill opening therein closed by a removable lid and a pair of substantially identically upstanding cylindrical plugs for providing fluid communication with the inside of the container. One plug is connected to a $CO_2$ source and the other plug is connected to a syrup line.

It is known to install small, plastic, tamper evident caps on each plug after the figal has been filled. These caps can not be removed without breaking them. They have internal locking teeth that engage an annular o-ring groove on the plug and they include a tab to grab and pull on to rupture or break the cap to remove it to gain access to the plugs to dispense the syrup from the figal. Thus, as long as the caps are in place, that is evidence that no tampering has occurred, unless the original caps have been replaced by new caps. Such caps are relatively inexpensive and easy to duplicate.

SUMMARY OF THE INVENTION

A one-piece tamper evident device for a syrup container (or figal) including (1) a U-shaped body including a pair of spaced apart arms and an enlarged lower handle portion joining the two arms, (2) the handle having a smooth, flat, rectangular upper surface for receiving a product identification label, (3) a socket on the distal end of each arm and including a plurality of locking teeth for locking onto a figal plug, and (4) each socket having a fracture zone that will break when the handle is grasped and lifted.

It is an object of this invention to provide an improved tamper evident figal cap.

It is another object of this invention to provide a tamper evident figal cap that also is a dust cap and that also provides a top surface for a product identification label.

It is a further object of this invention to provide a tamper evident figal cap that is more difficult to duplicate and to install.

BRIEF DESCRIPTION OF THE DRAWINGS

The present invention will be more fully understood from the detailed description below when read in connection with the accompanying drawings wherein like reference numerals refer to like elements and wherein.

DETAILED DESCRIPTION OF THE PREFERRED EMBODIMENT

Figure 1:
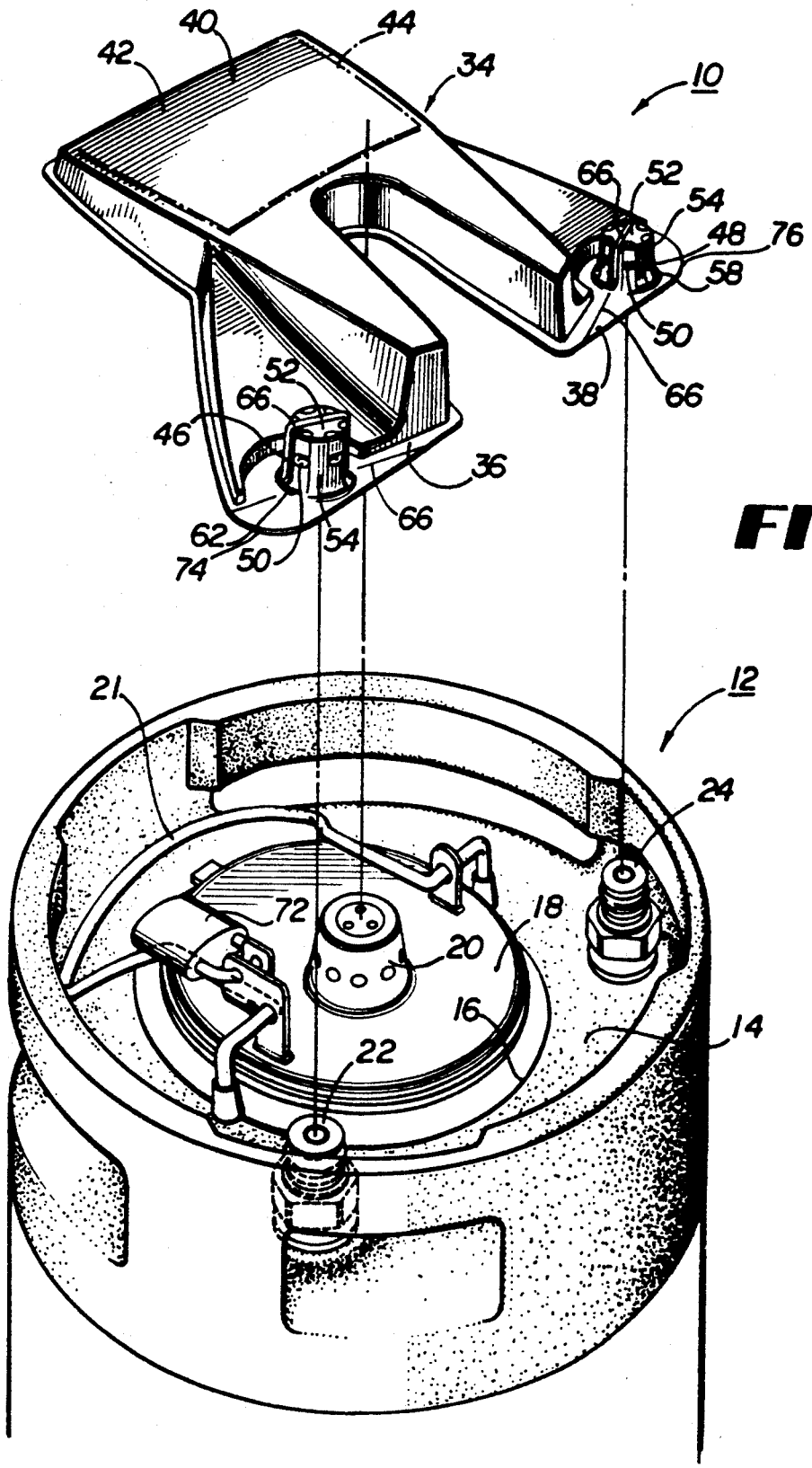
FIG. 1 is a perspective view of the top of a figal and of a tamper evident figal device according to the present invention.
Figure 2:
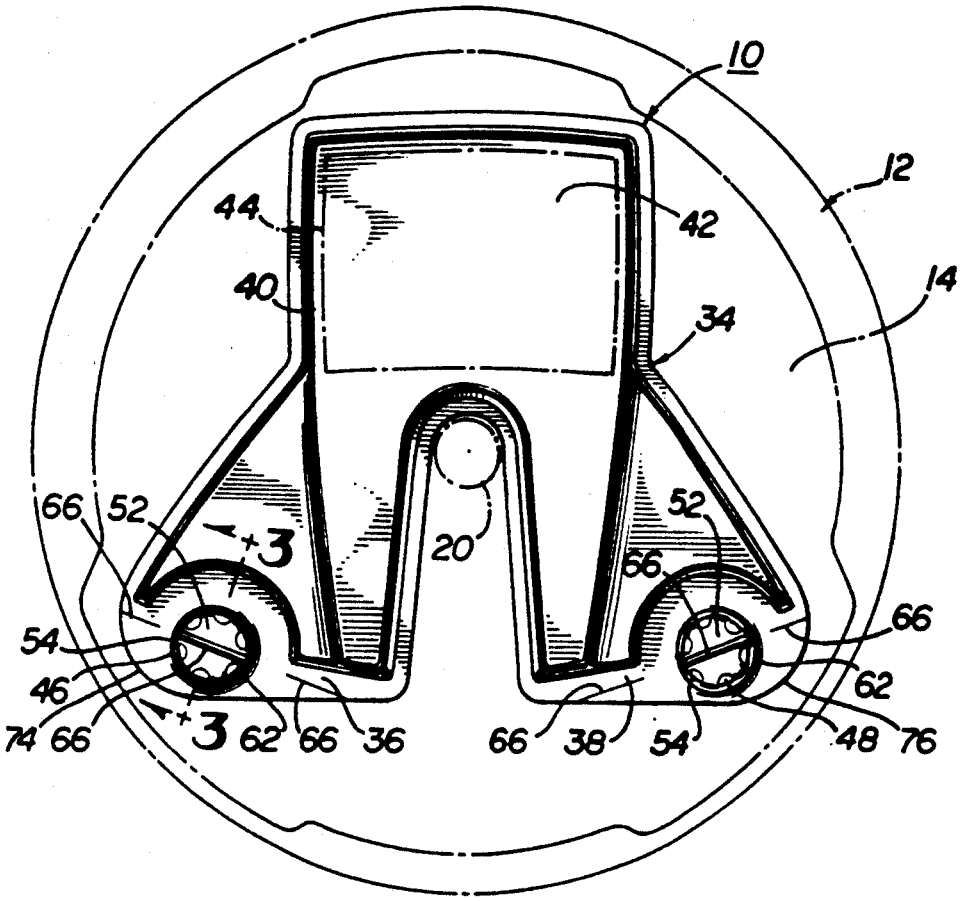
FIG. 2 is a top view of the device of FIG. 1.
Figure 3:
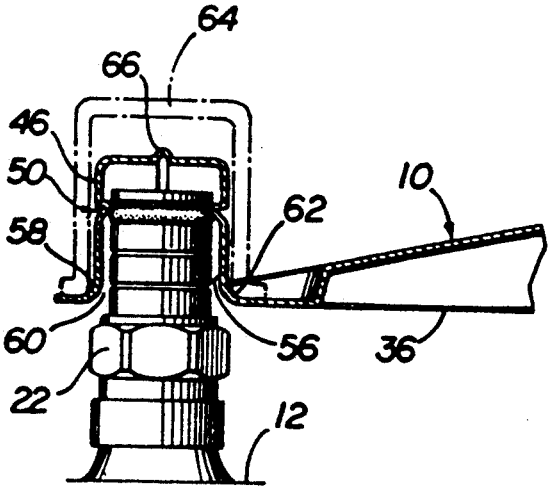
FIG. 3 is a partial, partly cross-sectional side view of the device as installed on a figal plug.
Figure 4:
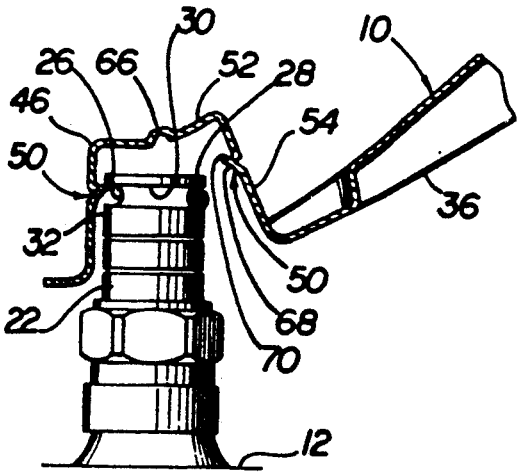
FIG. 4 is a view as in FIG. 3 showing the socket breaking during removal of the device from a figal.

With reference now to the drawings, FIGS. 1–4 show the tamper evident device 10 of the present invention for use with a syrup container (figal) 12.

The figal is well-known in the art and is a five gallon stainless steel container having a top wall 14 with a fill opening 16 closed by a removable lid 18 having a pressure vent 20 and a handle (or bail 21). The top wall 14 includes a pair of substantially identical, upstanding, cylindrical plugs 22 and 24, one for connecting to a $CO_2$ line and one to a syrup line, as is well-known.

Each of the plugs 22 and 24 includes an annular o-ring groove 26 for holding an o-ring 28. The groove 26 includes an upper locking surface 30 perpendicular to the side surface 32 of the plug.

The tamper evident device 10 includes a generally U-shaped body 34 including a pair of spaced-apart arms 36 and 38 joined by an enlarged handle portion 40. The handle portion has a smooth, relatively flat, rectangular upper surface 42 having an area of preferably about 7.5 square inches, for receiving a product identifying label.

A hollow, cylindrical socket is located adjacent the distal end of each arm and includes a plurality of locking teeth 50 for locking engagement with the locking surface 30 of a plug for installing each of the sockets 46 and 48 onto one of the plugs 22 and 24. The sockets can not be removed without breaking them. The sockets are identical, so only one need be described. The socket 46 includes imperforate top and side walls 52 and 54 enclosing an internal plug-receiving chamber 56, the diameter of which is substantially identical to the outside diameter of said plugs. The socket 46 extends upwardly from a base 58 integral with the arm 36. The socket includes a bottom opening 60 for receiving the plug 22 into the chamber 56. An annular flat surface 62 surrounds the base and provides a surface against which an installation tool 64 can push to install the socket on the plug. If one pushes down on top of the socket, the socket will preferably break.

The socket 46 includes a weakened fracture zone 66, such as a score line. This can be provided during the manufacture of the device 10 although preferably it is made after manufacture. Any suitable type of fracture zone or weakened rupture area or break line or lines can be used.

There are preferably six evenly circumferentially spaced-apart locking teeth 50. The teeth are in a common plane perpendicular to the axis of the cylindrical socket and include a tapered lower surface 68 and a flat locking surface 70 perpendicular to the cylindrical side wall 54 of the socket.

The tapered surface preferably is concave to conform to the o-ring. The inner diameter of the teeth (the circle touching the inside of each tooth) is smaller in diameter than the outside diameter of the plug. Thus, the socket must be flexible and must flex enough to allow the socket to lock onto the plug.

Sometimes the plugs 22 and 24, which are originally parallel, are hit or otherwise knocked crooked. The arms 36 and 38 are flexible so as to roll about the longitudinal axis thereof to allow the sockets to be installed even on such crooked plugs. The sockets are parallel to each other when formed.

The device is preferably made of polystryene by thermoforming and preferably includes two different layers bonded together, one layer being more brittle than the other. The teeth 50 are preferably made during the thermoforming operation as a subsequent separate step thereof. The fracture zone 66 is preferably made subsequent to the thermoforming operation.

It is noted that the two arms 36 and 38 are spaced apart enough to accommodate the pressure vent 20. In the preferred embodiment, the arms 36 and 38 each have an outwardly extending ear 76 and 74 and the sockets 46 and 48 are preferably located on the distal ends of these ears.

The device 10 is installed using the tool 64 (or using a single tool combining two tools 64 can be used so that only a single installation operation is necessary), after the figal 12 is filled with syrup and the lid 18 installed. The lid is usually also padlocked to the container by a padlock 72, to aid in preventing tampering. Such procedure can be omitted with the present invention or can be continued, as desired. To remove the device 10 to dispense the syrup therefrom, it is only necessary to grasp the handle 40 and lift and twist; this action will break both sockets along their fracture zones.

While the primary importance of the device 10 is to provide a tamper evident device, reference was made above to the label 44 on the handle 40. When a plurality of figals are located side-by-side, the labels on their sides are often not visible, thus various identification means (such as tags) are applied on the tops of the figals by the users thereof to easily provide product identification from the top. These means must then be removed (because the figals may be refilled with a different product) and this is often both difficult and time consuming. The large area on top of the handle provides an area for a large label and thus solves this problem.

While the preferred embodiment of this invention has been described above in detail, it is to be understood that variations and modifications can be made therein without departing from the spirit and scope of the present invention.

What is claimed is:

1. A tamper evident device in combination with a soft drink syrup container comprising:

(a) a soft drink syrup container having a top wall with a central fill opening therein closed by a removable lid and a pair of cylindrical, substantially identical, spaced-apart, upstanding, generally parallel plugs for providing fluid communication with the inside of said container, each of said plugs including an annular o-ring groove on a side surface thereof, said groove including an upper locking surface thereof perpendicular to said plug side surface;

(b) a one-piece tamper evident device for attachment to said container, said device including (1) a generally U-shaped body including a pair of spaced-apart arms and an enlarged lower handle portion joining said two arms together;

(2) said handle portion having a smooth, relatively flat, rectangular upper surface;

(3) a pair of substantially identical cylindrical, upstanding sockets, each having an internal plug-receiving chamber and each located adjacent the distal end of a respective one of said arms, each socket having a base adjacent the respective one of said arms and extending upwardly therefrom, each socket including a top wall, a side wall, a bottom opening into said chamber, and a plurality of locking teeth inside said chamber, said locking teeth being in a common plane and being circumferentially spaced-apart and having a tapered lower surface and a perpendicular locking surface, said socket and locking teeth being flexible enough to be pushed down over one of said plugs such that said locking teeth extend into said annular groove in locking engagement therein such that said socket can not be pulled off of said plug without breaking said socket;

(c) an annular flat surface on the top surface of said device surrounding the base of each of said sockets for being engaged by a socket applying tool;

(d) each of said arms being flexible to allow each of said sockets to lock onto said plugs even if said plugs are no longer exactly parallel; and (e) each of said sockets having a weakened fracture zone such that when said handle is grasped and lifted, said sockets will break off of said plugs along said fracture zones.

2. The device as recited in claim 1 wherein the inside diameter of each of said sockets is substantially identical to the outside diameter of said plugs, and wherein the inside diameter defined by said locking teeth is smaller the outside diameter of said plugs, and said sockets are sufficiently flexible to flex into locking position on said plugs.

3. The device as recited in claim 1 wherein said plurality of locking teeth comprises six locking teeth in each of said sockets.

4. The device as recited in claim 1 wherein said fracture zone includes a weakened diametrical score line across the top surface of each of said sockets.

5. The device as recited in claim 1 wherein each of said arms has a longitudinal axis and is flexible about said longitudinal axis.

6. The device as recited in claim 1 wherein said device is made of polystyrene.

7. The device as recited in claim 6 wherein said device is made of two separate polystyrene layers bonded together.

8. The device as recited in claim 7 wherein one of said layers is more brittle than the other layer.

9. The device as recited in claim 1 wherein said removable lid includes a pressure vent extending upwardly therefrom, and wherein said arms of said device are spaced-apart a distance greater than the width of said pressure vent to accommodate said vent between said arms.

10. The device as recited in claim 1 including a product identification label adhered to said upper surface of said handle portion.

11. The device as recited in claim 10 wherein said upper surface of said handle portion has an area of at least 7.5 square inches.

12. The device as recited in claim 1 wherein each of said arms includes an outwardly extending ear portion and wherein said socket is located on adjacent the distal end of said ear portion.

13. The device as recited in claim 1 wherein said sockets are imperforate so as to provide dust caps over said plugs.

14. The device as recited in claim 1 including an o-ring in said groove of each of said plugs and wherein said tapered surface of each of said teeth is concave to conform with said o-ring.

15. A one-piece tamper evident device comprising:

(a) a generally U-shaped body including a pair of spaced-apart arms and an enlarged lower handle portion joining said two arms together;

(b) said handle portion having a smooth, relatively flat, rectangular, label receiving upper surface having an area of 7.5 square inches;

(c) a pair of substantially identical, cylindrical, hollow, upstanding sockets, each having an internal plug-receiving chamber and each located adjacent the distal end of a respective one of said arms, each socket having a base adjacent the respective one of said arms and extending upwardly therefrom, each socket including a top wall, a side wall, a bottom opening into said chamber, and a plurality of locking teeth inside said chamber, said locking teeth being in a common plane perpendicular to the axis of the socket and being circumferentially spaced-apart and each having a tapered lower surface and a perpendicular upper locking surface;

(d) an annular flat surface on the top surface of said device surrounding the base of each of said sockets for being engaged by a socket applying tool;

(e) each of said arms having a longitudinal axis and being flexible about said longitudinal axis; and (f) each of said sockets having a weakened fracture zone therein such that when said handle is lifted and twisted, said sockets will break off of any plugs received in said chambers, along said fracture zones.

16. The device as recited in claim 15 wherein said plurality of locking teeth comprises six locking teeth in each of said sockets.

17. The device as recited in claim 16 wherein said device is made of polystyrene.

18. The device as recited in claim 17 wherein said device is made of two separate polystyrene layers bonded together.

19. The device as recited in claim 18 wherein one of said layers is more brittle than the other layer.

20. The device as recited in claim 19 including a product identification label adhered to said upper surface of said handle portion.

21. The device as recited in claim 15 wherein said sockets are imperforate so as to provide dust caps over said plugs.

* * * * *